US009747840B2

(12) United States Patent
Bi et al.

(10) Patent No.: US 9,747,840 B2
(45) Date of Patent: Aug. 29, 2017

(54) DISPLAY WITH PEAK LUMINANCE CONTROL SENSITIVE TO BRIGHTNESS SETTING

(71) Applicant: Apple Inc., Cupertino, CA (US)

(72) Inventors: Yafei Bi, Palo Alto, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/167,549

(22) Filed: May 27, 2016

(65) Prior Publication Data

US 2016/0275865 A1 Sep. 22, 2016

Related U.S. Application Data

(63) Continuation of application No. 14/329,197, filed on Jul. 11, 2014, now Pat. No. 9,396,684.
(Continued)

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3275* (2013.01); *G09G 2300/0828* (2013.01); *G09G 2300/0861* (2013.01); *G09G 2310/027* (2013.01); *G09G 2320/029* (2013.01); *G09G 2320/0295* (2013.01); *G09G 2320/043* (2013.01);
(Continued)

(58) Field of Classification Search
CPC ... G09G 3/3258; G09G 3/3233; G09G 3/3275
See application file for complete search history.

(56) References Cited

U.S. PATENT DOCUMENTS 5,870,154 A 2/1999 Conover et al.
6,762,741 B2 7/2004 Weindorf
(Continued)

FOREIGN PATENT DOCUMENTS

CN 101030346 A 9/2007
CN 101110188 A 1/2008
(Continued)

*Primary Examiner* — Kevin M Nguyen
(74) *Attorney, Agent, or Firm* — Treyz Law Group, P.C.; G. Victor Treyz; Joseph F. Guihan

(57) ABSTRACT

A display may have an array of display pixels to display images. Digital display data may be received by a digital-to-analog converter. The digital-to-analog converter can convert the digital display data to analog display data for the display pixels. The magnitudes of the analog display data signals that the digital-to-analog converter provides to the display pixels can be controlled by a control signal such as a reference voltage received by the digital-to-analog converter. A brightness controller may have multiple peak luminance control profiles. A brightness setting may be processed by a look-up table to produce information identifying a selected one of the peak luminance control profiles. The brightness controller may use the selected peak luminance control profile and average frame luminance for the digital display data to produce the reference voltage that controls the digital-to-analog controller.

14 Claims, 8 Drawing Sheets

Related U.S. Application Data

(60) Provisional application No. 61/900,890, filed on Nov. 16, 2013.

(51) Int. Cl.
*G09G 3/3275* (2016.01)
*G09G 3/3233* (2016.01)

(52) U.S. Cl.
CPC ..... *G09G 2320/0606* (2013.01); *G09G 2320/0626* (2013.01); *G09G 2320/0673* (2013.01); *G09G 2320/0693* (2013.01); *G09G 2330/021* (2013.01); *G09G 2330/12* (2013.01); *G09G 2354/00* (2013.01); *G09G 2360/144* (2013.01); *G09G 2360/16* (2013.01)

(56) References Cited

U.S. PATENT DOCUMENTS

| | | | | |
|---|---|---|---|---|
| 8,730,275 | B2 | 5/2014 | Mori | |
| 2005/0190142 | A1 | 9/2005 | Ferguson | |
| 2009/0213049 | A1* | 8/2009 | McCreary | G09G 3/3233 345/80 |
| 2010/0253664 | A1 | 10/2010 | Byun et al. | |
| 2011/0254878 | A1 | 10/2011 | Mori et al. | |
| 2012/0287143 | A1 | 11/2012 | Brown Elliott | |
| 2013/0335457 | A1 | 12/2013 | Yano et al. | |
| 2014/0152705 | A1* | 6/2014 | Kwon | G09G 3/3275 345/690 |
| 2014/0176409 | A1* | 6/2014 | Kim | G09G 3/3233 345/92 |
| 2014/0347253 | A1* | 11/2014 | Lee | H05B 33/0896 345/76 |

FOREIGN PATENT DOCUMENTS

| | | | |
|---|---|---|---|
| CN | 101510390 | A | 8/2009 |
| CN | 101814267 | B | 11/2012 |
| TW | 200744046 | | 12/2007 |
| TW | 200844941 | | 11/2008 |
| TW | 200917206 | A | 4/2009 |
| TW | 200920123 | | 5/2009 |
| TW | 201128613 | | 8/2011 |
| TW | 201214397 | | 4/2012 |

* cited by examiner

14

DISPLAY WITH PEAK LUMINANCE CONTROL SENSITIVE TO BRIGHTNESS SETTING

This application is a continuation of patent application Ser. No. 14/329,197, filed Jul. 11, 2014, which claims the benefit of provisional patent application No. 61/900,890, filed Nov. 6, 2013, which are hereby incorporated by reference herein in their entireties.

BACKGROUND

This relates generally to electronic devices and, more particularly, to electronic devices with displays.

Electronic devices often include displays. The overall brightness level of many displays is adjustable. For example, a display may have a brightness setting that can be increased or decreased manually by a user. A display might also have a brightness setting that is automatically adjusted in response to ambient light measurements. With this type of automatic brightness level control, the display can be automatically made brighter when ambient lighting conditions become bright to help ensure that the display remains visible to the user.

To ensure that displays do not consume too much power and to help enhance display longevity, electronic devices often use a peak luminance control algorithm (sometimes referred to as automatic current limiting).

When peak luminance control functionality is enabled, the peak luminance of displayed images is reduced whenever the content being displayed exhibits large values of average frame luminance. This ensures that the amount of current and therefore the amount of power that is drawn by the display will be capped. In addition to limiting power consumption, this may help limit temperature rise in the display and thereby extend the lifetime of display pixels in the display.

When the average luminance of a frame of image data is low, the display is allowed to display content with a large peak luminance. In this situation, a display with sparse content such as a few icons on a black background can display the content brightly.

Challenges arise when using a device that has an adjustable display brightness setting and a simultaneously active peak luminance control algorithm. As an example, in dim lighting conditions or other situations in which the brightness setting is low, the use of a peak luminance control algorithm that further reduces luminance upon detection of frames of data with high average luminance may reduce luminance so much as to make it difficult or impossible to view content on the display.

It would therefore be desirable to be able to provide improved ways in which to handle brightness settings and peak luminance control operations in a display.

SUMMARY

An electronic device may include a display having an array of display pixels. The array of display pixels may contain rows and columns of organic light-emitting diode display pixels that display images for a user.

Digital image data may be provided to a digital-to-analog converter. The digital-to-analog converter can convert the digital display data to analog display data that is provided to columns of the display pixels in the array. The magnitudes of the analog display data signals that the digital-to-analog converter provides to the display pixels can be controlled by a control signal such as a reference voltage that is received by the analog-to-digital converter.

A brightness controller may maintain multiple peak luminance control profiles each corresponding to a respective peak luminance control algorithm. The peak luminance control profiles may be used to reduce the value of the reference voltage (and therefore the magnitudes of the display signals and luminance of the display) in situations in which the average luminance of frames of digital display data is high, thereby conserving power and extending display pixel lifetime. Each peak luminance control profile may be optimized for use with a different brightness setting.

A user may supply the electronic device with a display brightness setting using an input-output device. The electronic device may also obtain brightness settings based on ambient light sensor readings. A user-provided or sensor-based display brightness setting may be processed by a circuit such as a look-up table. The look-up table may have an output that provides information such as a profile number or other identifier that identifies a selected one of the peak luminance control profiles that is appropriate to use for a given brightness setting. The brightness controller may use the selected peak luminance control profile and an average frame luminance value for the digital image data to produce the reference voltage that controls the digital-to-analog controller.

DETAILED DESCRIPTION

Figure 1:
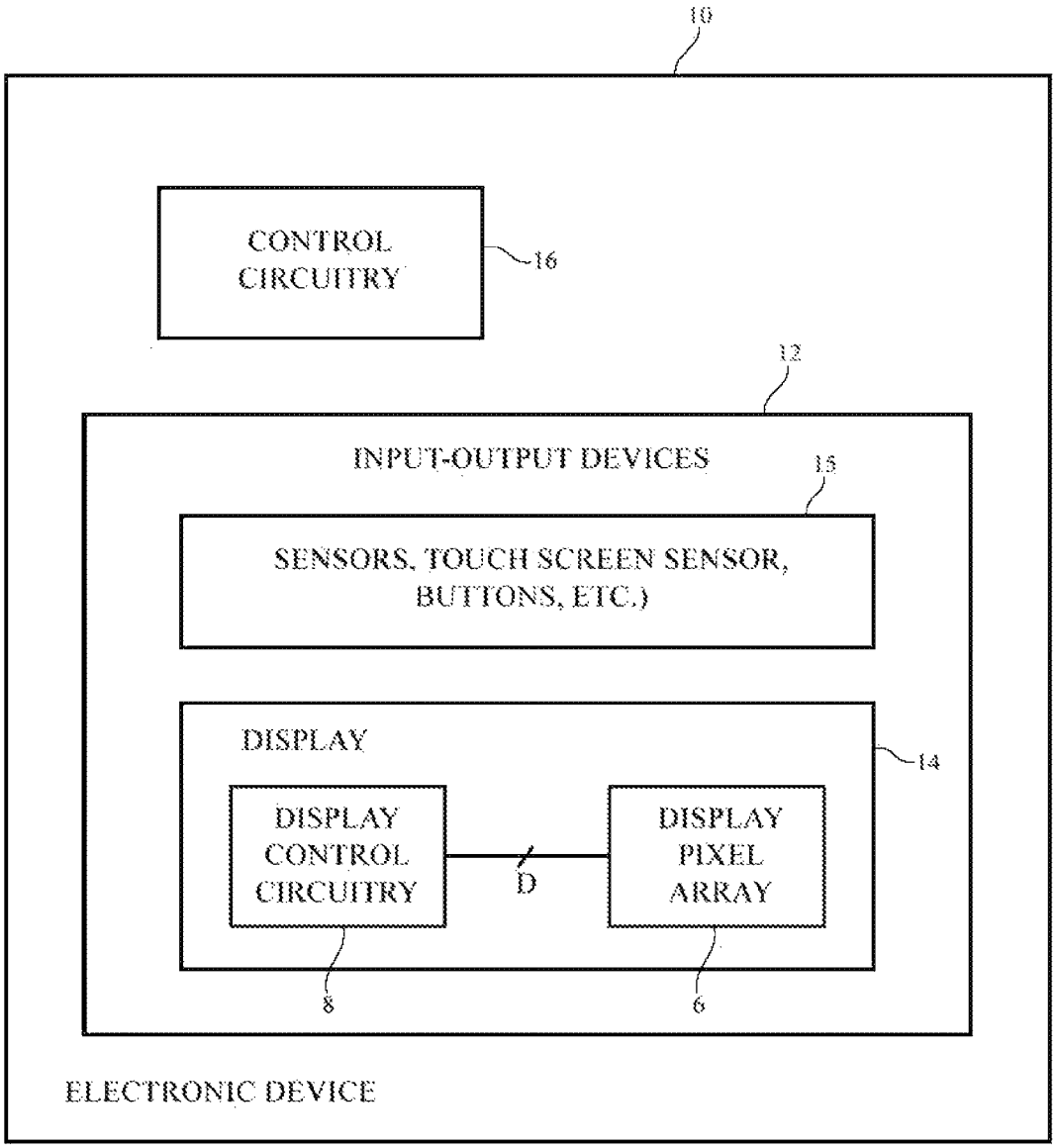
FIG. 1 is a diagram of an illustrative electronic device having a display in accordance with an embodiment.

An illustrative electronic device of the type that may be provided with an organic light-emitting diode display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, non-volatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio codec chips, application specific integrated circuits, etc. Control circuitry 16 may be used to run software on device 10 such as operating system code and applications.

Input-output circuitry in device 10 such as input-output devices 12 may be used to allow data to be supplied to device 10 and to allow data to be provided from device 10 to external devices. Input-output devices 12 may include buttons, joysticks, click wheels, scrolling wheels, touch pads, key pads, keyboards, microphones, speakers, tone generators, vibrators, cameras, sensors (e.g., one or more ambient light sensors), light-emitting diodes and other status indicators, data ports, and other input-output components 15. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements. Display 14 may have one or more integrated circuits that form display control circuitry 8 (e.g., a timing controller integrated circuit, gate driver circuitry, column driver circuitry, etc.). Display control circuitry 8 may be used to supply data signals D to columns of display pixels in display pixel array 6. Display control circuitry 8 may also provide control signals (sometimes referred to as gate line signals or scan signals) that are used in addressing rows of display pixels in display pixel array 6. When displaying a frame of data on display 14, display control circuitry 8 may, for example, sequentially assert a gate line signal in each row of display pixel array 6 while analog data signals D are being provided on respective data lines to each column of display pixel array 6. Display pixel array 6 may contain display pixels based on liquid crystal display technology, organic light-emitting diode display pixels, or display pixels formed using other display technologies. Configurations in which display 14 is an organic light-emitting diode display are sometimes described herein as an example. This is merely illustrative. Display 14 may be any suitable type of display.

Figure 2:
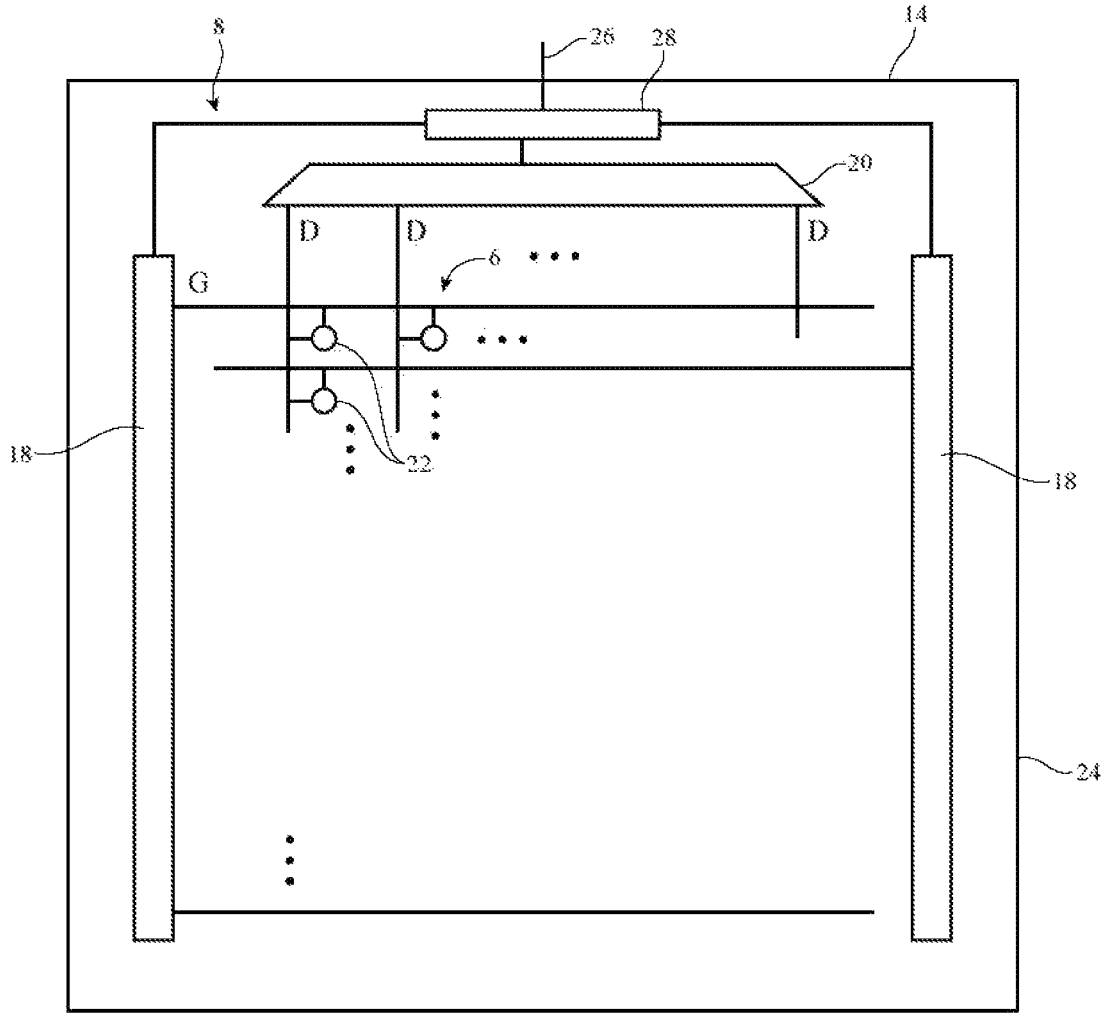
FIG. 2 is a diagram of an illustrative display in accordance with an embodiment.

As shown in the illustrative diagram of FIG. 2, display 14 may have a rectangular array of display pixels 22 for displaying images for a user. The array of display pixels 22 may be formed from rows and columns of display pixel structures (e.g., display pixels formed from structures on display layers such as substrate 24). There may be any suitable number of rows and columns in the array of display pixels 22 (e.g., ten or more, one hundred or more, or one thousand or more).

Display control circuitry 8 (e.g., display driver circuitry) such as display driver integrated circuit 28 may be coupled to conductive paths such as metal traces on substrate 24 using solder or conductive adhesive. Display driver integrated circuit 28 (sometimes referred to as a timing controller chip) may contain communications circuitry for communicating with system control circuitry over path 26. Path 26 may be formed from traces on a flexible printed circuit or other cable. System control circuitry may include a microprocessor, application-specific integrated circuits, and other resources and may be located on a main logic board in an electronic device in which display 14 is being used. During operation, the control circuitry on the logic board (e.g., control circuitry 16 of FIG. 1) may supply display control circuitry 8 such as display driver integrated circuit 28 with information on images to be displayed on display 14.

To display the images on display pixels 22, display driver integrated circuit 28 may supply corresponding analog image data to data lines D while issuing clock signals and other control signals to display driver circuitry such as gate driver circuitry 18 and demultiplexing and column driver circuitry 20.

Gate driver circuitry 18 (sometimes referred to as scan line driver circuitry) may be formed on substrate 24 (e.g., on the left and right edges of display 14, on only a single edge of display 14, or elsewhere in display 14). Circuitry 20 may be used to demultiplex data signals from display driver integrated circuit 28 onto a plurality of corresponding data lines D. With the illustrative arrangement of FIG. 2, data lines D run vertically through display 14. Each data line D is associated with a respective column of display pixels 22. Gate lines G (sometimes referred to as scan lines) run horizontally through display 14. Each gate line G is associated with a respective row of display pixels 22. If desired, there may be multiple gate lines (scan lines) associated with each row of display pixels. Gate driver circuitry 18 may be located on the left side of display 14, on the right side of display 14, or on both the right and left sides of display 14, as shown in FIG. 2.

Gate driver circuitry 18 may assert gate signals (sometimes referred to as scan signals) on the gate lines G in display 14. For example, gate driver circuitry 18 may receive clock signals and other control signals from display driver integrated circuit 28 and may, in response to the received signals, assert a gate signal on gate lines G in sequence, starting with the gate line signal G in the first row of display pixels 22. As each gate line is asserted, data from data lines D is located into the corresponding row of display pixels. In this way, display control circuitry 28, 20, and 18 and other display control circuitry 8 in device 10 may provide display pixels 22 with signals that direct display pixels 22 to generate light for displaying a desired image on display 14.

During operation of device 10, the software running on control circuitry 16 may display images on display 14 by providing digital display data to display control circuitry 8. Digital image data may be displayed in frames on display pixel array 6 by display control circuitry 8. Each frame of data may contain rows and columns of data bits corresponding to the rows and columns of display pixels 22 in display pixel array 6.

Each bit of image data may have one of a number of possible digital values. As an example, each bit may represent a digital level (sometimes referred to as a digital gray level) having one of 256 gray level values ranging from G0 (for a black pixel) to G255 (for a white pixel). Bits with intermediate values may correspond to gray pixel output. The use of colored pixels in array 6 (e.g., red, green, and blue display pixels) provides display 14 with the ability to display color images.

Figure 3:
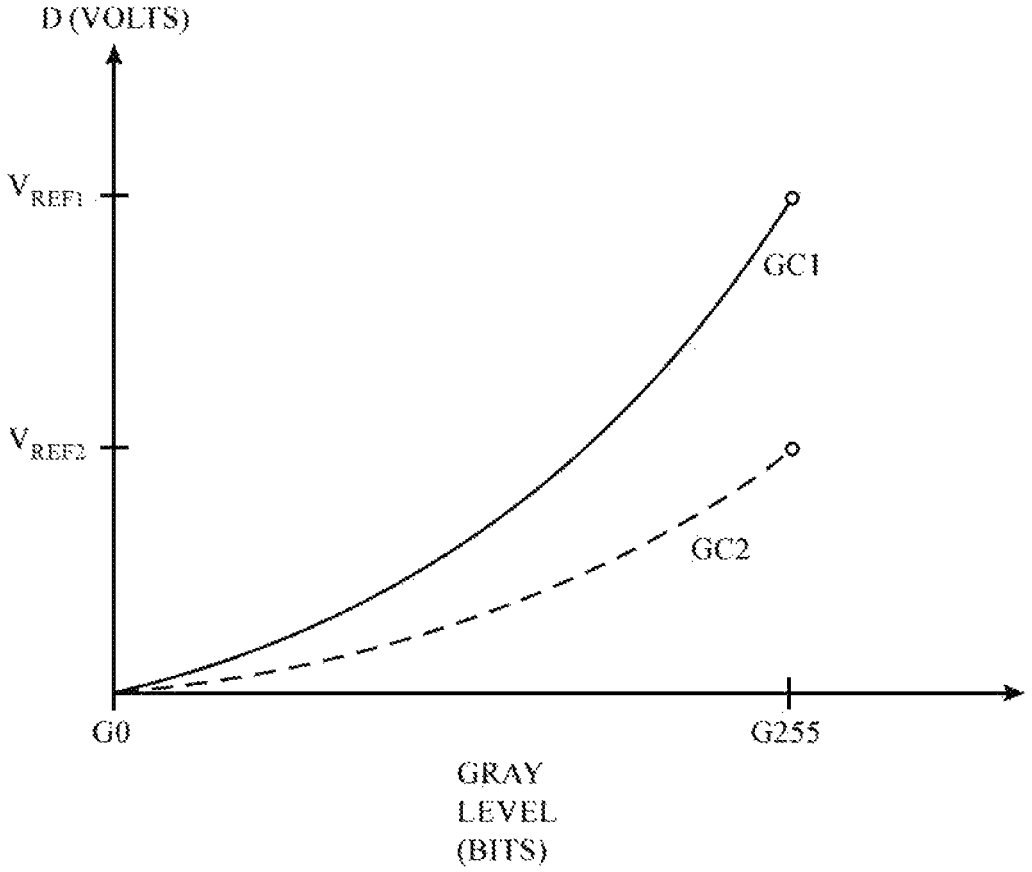
FIG. 3 is a graph showing how the magnitude of analog display data signals varies as a function of digital data values (gray levels) for different display operating conditions in accordance with an embodiment.

A digital-to-analog converter, sometimes referred to as a gamma reference block, may be used to convert digital display data (e.g., gray level values) to analog display data D (e.g., voltage signals corresponding to desired luminance values). FIG. 3 is a graph showing illustrative relationships between digital display data (i.e., gray levels) and analog display data (i.e., analog data signals driven onto a data lines D of FIG. 2) for two different digital-to-analog converter operating conditions. The curves of FIG. 3 show the relationship between digital display data and analog display data D and are sometimes referred to as gamma curves.

During operation of display 14, digital display data (gray level data) is received as an input to the gamma reference block and corresponding analog display data D is provided as an output. A control signal that is sometimes referred to as reference voltage Vref may serve as a control signal input to the gamma reference block. The magnitude of signal Vref controls the size of the data signals D that are produced as a function of gray level input to the gamma reference block. If, for example, Vref is set to a value of Vref1, output data D will follow gamma curve GC1. If Vref is set to a value of Vref2, output data D will follow gamma curve GC2. In this example, curve GC2 is associated with lower output values D than curve GC2 and as a result, display 14 will exhibit lower light output and a smaller maximum luminance when its display pixels are driven in accordance with curve GC2 rather than curve GC1.

The value of Vref that is to be applied to the digital-to-analog converter at a given point in time may be determined dynamically by a brightness controller. The brightness controller may be implemented using dedicated brightness control circuitry and/or a brightness control algorithm implemented using control circuitry resources such as a microprocessor and memory. The brightness controller may receive a first input such as an average frame luminance input or other information related to the luminance of the digital data to be displayed on display pixel array 6 and may receive a second input such a peak luminance control profile number or other input identifying which peak luminance control profile is to be used in displaying data on display pixel array 6.

During operation, the brightness controller can select an appropriate peak luminance control profile to use in response to the second input. Based on the first input and based on the selected peak luminance control profile, the brightness controller can produce a value of Vref for the analog-to-digital controller (i.e., the gamma reference block).

Figure 4:
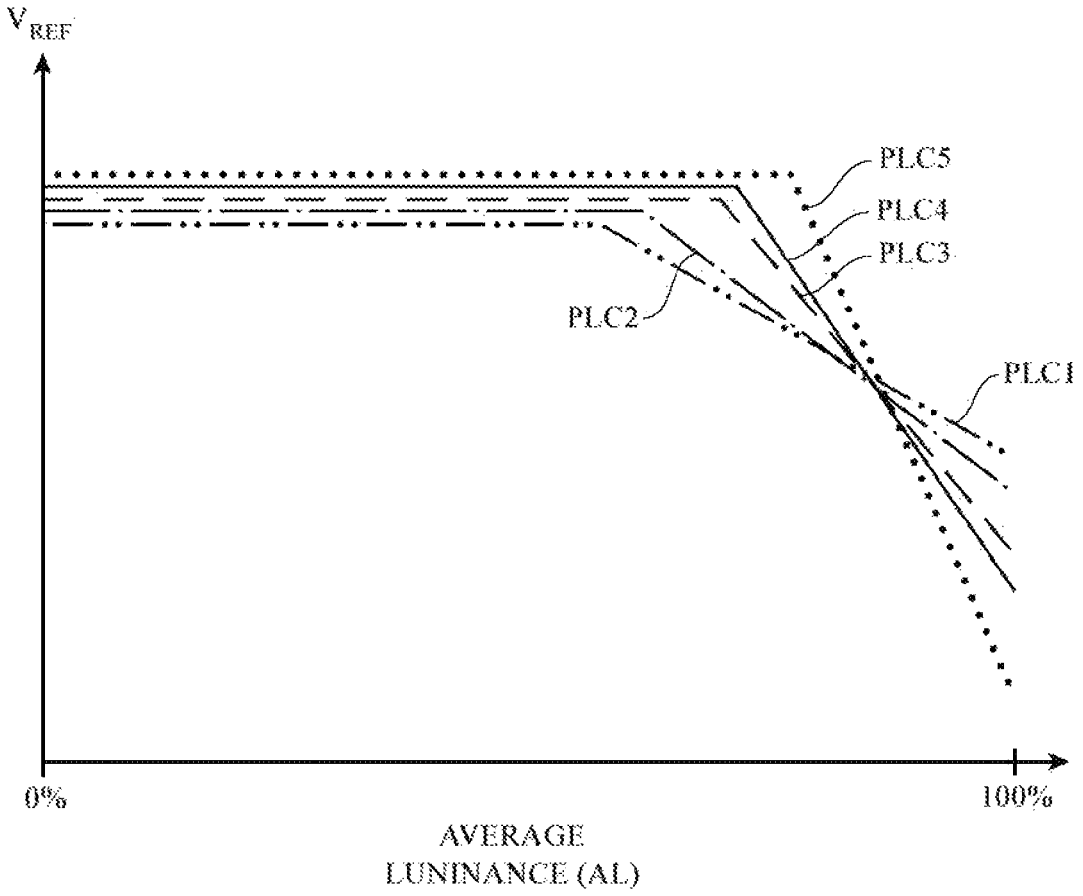
FIG. 4 is a graph in which multiple peak luminance control profiles for use with different respective display brightness settings have been plotted in accordance with an embodiment.

FIG. 4 is a graph that shows illustrative peak luminance control profiles that may be used by the brightness controller: PLC1, PLC2, PLC3, PLC4, and PLC5. In general, there may be any suitable number of peak luminance control profiles that are implemented using display control circuitry 8. The illustrative scenario of FIG. 4 involves the use of five profiles. Each peak luminance control profile may be optimized to operate in conjunction with a different respective brightness setting.

Display control circuitry 8 may receive manual input from a user related to a desired brightness setting and/or may automatically determine which brightness setting is to be used for display 14 based on ambient light measurements with an ambient light sensor. As an example, a user may use a touch screen or other input-output component 15 to supply a desired user brightness setting to device 10. A reading from an ambient light sensor may also be used to determine current ambient lighting conditions for device 10 and display 14. In situations in which ambient lighting is bright, device 10 can automatically select a brightness setting that is high, so that images will be visible on display 14. In situations in which ambient lighting is dim, device 10 can automatically select a low brightness setting. Combinations of manual and/or automatic control schemes may also be used in selecting a desired display brightness setting (sometimes referred to as a user brightness setting).

In conventional displays, a peak luminance control algorithm may dim a display when frames of high average frame luminance are being displayed, even if the brightness setting is already very dim. The combined dimming of the display by both the peak luminance control algorithm and the dim brightness setting may make the display overly dim.

The brightness controller in display control circuitry 8 preferably selects a peak luminance control profile to use that is based on the brightness setting. For example, in bright lighting conditions (i.e., situations in which the brightness setting is high), a peak luminance control profile such as profile PLC1 of FIG. 4 may be used (i.e., dimming is fairly aggressive at elevated luminance values because the risk of over-dimming in a situation with a high brightness setting is low). In dim lighting conditions (i.e., in situations in which the user brightness setting is low), a peak luminance control profile such as profile PLC5 of FIG. 4 may be used (i.e., a profile with less aggressive dimming at elevated average luminance values to avoid over-dimming). Peak luminance control profiles such as profiles PLC2, PLC3, and PLC4 may be used in intermediate lighting conditions (i.e., when correspondingly intermediate user brightness settings are desired).

Consider, as an example, profile PLC5. When ambient lighting is dim, it is desirable to limit the amount of display pixel luminance reduction that is implemented by the peak luminance control profile, thereby avoiding an overly dim display. As illustrated by the shape of profile PLC5, this is accomplished by maintaining high (unreduced) Vref values at relatively high values of average frame luminance AL. When ambient lighting is dim, more appropriate profiles such as one of profiles PLC1, PLC2, PLC3, or PLC4 can be used. The shapes of the illustrative profiles of FIG. 4 help avoid unexpected brightness increases that might otherwise arise in response to drops in the average frame luminance of the digital data.

Figure 5:
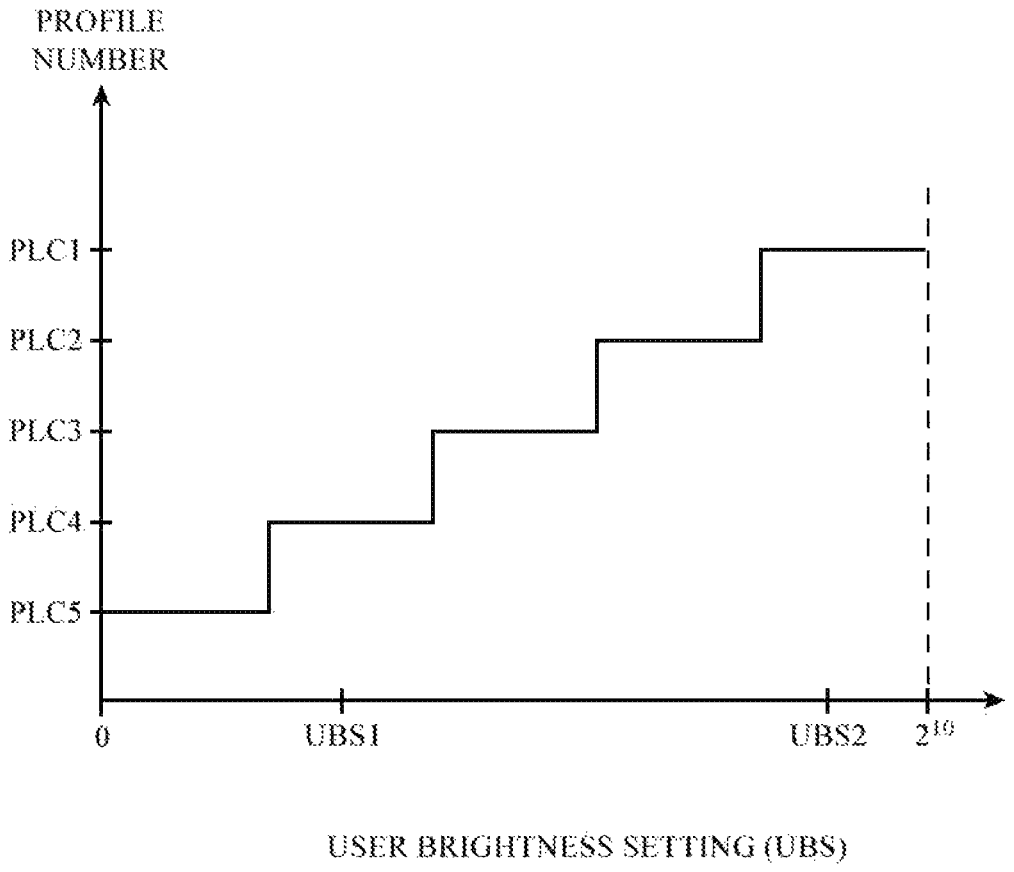
FIG. 5 is a graph showing how brightness settings may be used to select which peak luminance control profile of the multiple peak luminance control profiles of FIG. 4 should be used in controlling a display in accordance with an embodiment.

FIG. 5 shows an illustrative curve that may be used to map user brightness settings (e.g., digital brightness settings that range from 0 to $2^{10}$ or have other suitable values) to peak luminance control profiles (e.g., profiles PLC1 . . . PLC5 in the present example). The curve of FIG. 5 may be implemented using a circuit such as a look-up table that receives a brightness setting as an input and that produces a peak luminance control profile identifier such as a profile number or other information indentifying which profile is to be used for that brightness setting as a corresponding output.

Figure 6:
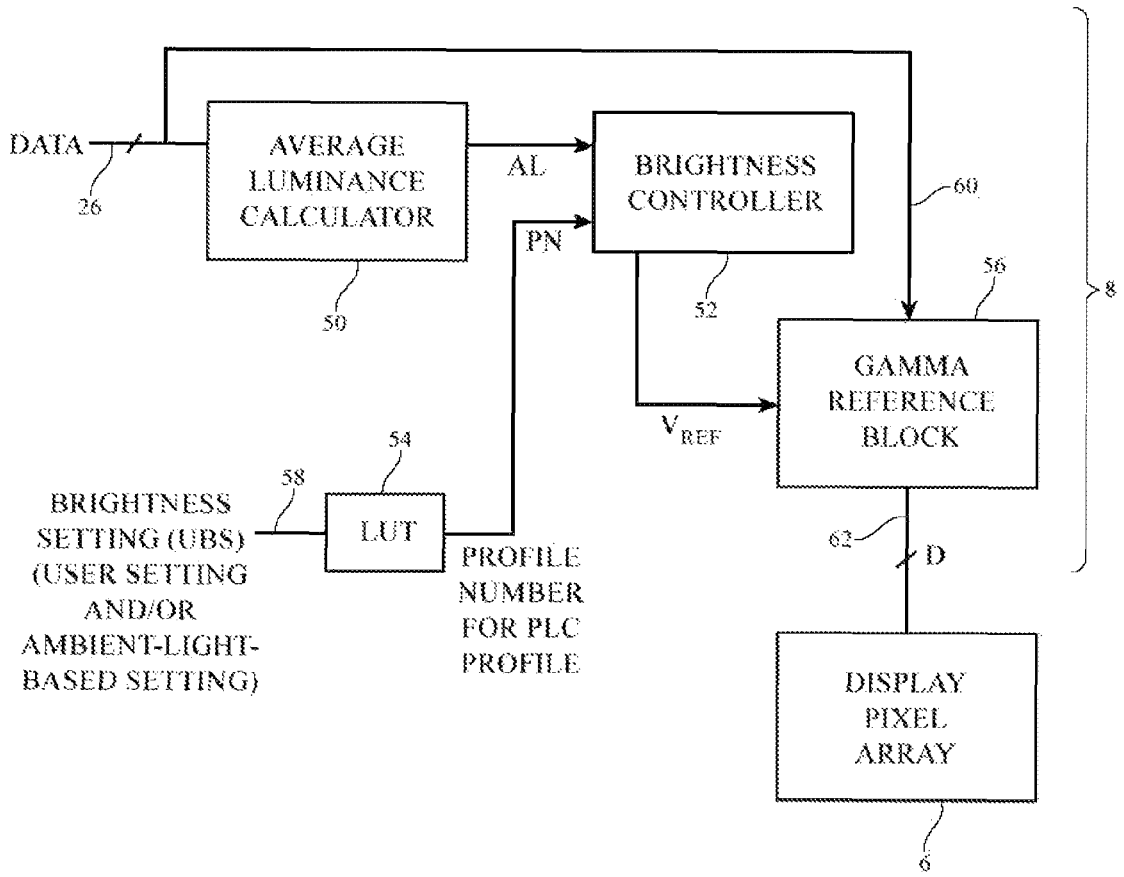
FIG. 6 is a diagram of control circuitry involved in displaying images on a display in accordance with an embodiment.

FIG. 6 is a schematic diagram of illustrative circuitry that may be used in implementing display 14 of device 10. As shown in FIG. 6, display 14 may have display control circuitry 8 for displaying images on display pixel array 6. Input 58 may be used to receive a user brightness setting from control circuitry 16. Control circuitry 16 may, for example, receive and process user input from input-output devices such as a touch sensor, button, or other input-output component 15. The user input may specify a desired brightness setting (e.g., high, medium, low, etc.). Alternatively, or in combination with receiving and processing user brightness setting input from a user, control circuitry 16 may gather input such as ambient light sensor readings from an ambient light sensor in input-output components 15. Ambient light measurements may be used to automatically determine an appropriate user brightness setting for display 14.

User brightness setting UBS may be received by control circuitry such as look-up table 54. Look-up table 54 may be used to implement a mapping such as the curve of FIG. 5 that maps user brightness setting values to peak luminance control profiles. For example, if the value of UBS is UBS1 of FIG. 5, the output of look-up table 54 will be PLC4 (profile 4), whereas if the value of UBS is UBS2 of FIG. 5, the output of look-up table 54 will be PLC2.

Digital display data to be displayed on display 14 may be received from a system controller (control circuitry 16) at digital data input 26. Average luminance calculator 50 may receive digital data (i.e., frames of digital data to display on display 14) and may calculate the average luminance AL of each frame of data or may extract other luminance information from the data frames.

Average luminance AL may serve as a first input to brightness controller 52. Peak luminance control profile number PN or other information identifying which profile is to be selected for use may serve as a second input to brightness controller 52. Brightness controller 52 may maintain multiple available peak luminance control profiles PL1, PL2, PL3, PL4, and PL5 in memory. In response to receipt of a given profile number PN, brightness controller 52 may select which peak luminance control profile is to be active. The selected peak luminance control profile may then be used in computing an output value of Vref based on the value of AL at the first input to controller 52 (see, e.g., FIG. 4).

Gamma reference block 56 is a digital-to-analog converter. Gamma reference block 56 coverts digital data on input 60 to corresponding analog data signals on respective data lines D at output 62. The data lines D supply the analog display data from gamma reference block 56 to respective columns of display pixels 22 in display pixel array 6 (see, e.g., FIG. 2).

The value of reference voltage Vref that is produced by brightness controller 52 is used as a control input to gamma reference block 56, as described in connection with FIG. 3. In this way, display 14 implements a peak luminance control scheme that is responsive to changes in brightness setting. Changes in brightness setting are used to adjust the shape of the peak luminance control curve that is used in mapping average luminance value AL to reference voltage Vref (and therefore to the magnitude of display data D). As a result, display pixel array 6 does not draw excessive current (or overly reduce display lifetime) while at the same time avoiding situations in which display 14 is overly dimmed due to simultaneous use of peak luminance control and an independent dim brightness setting.

Figure 7:
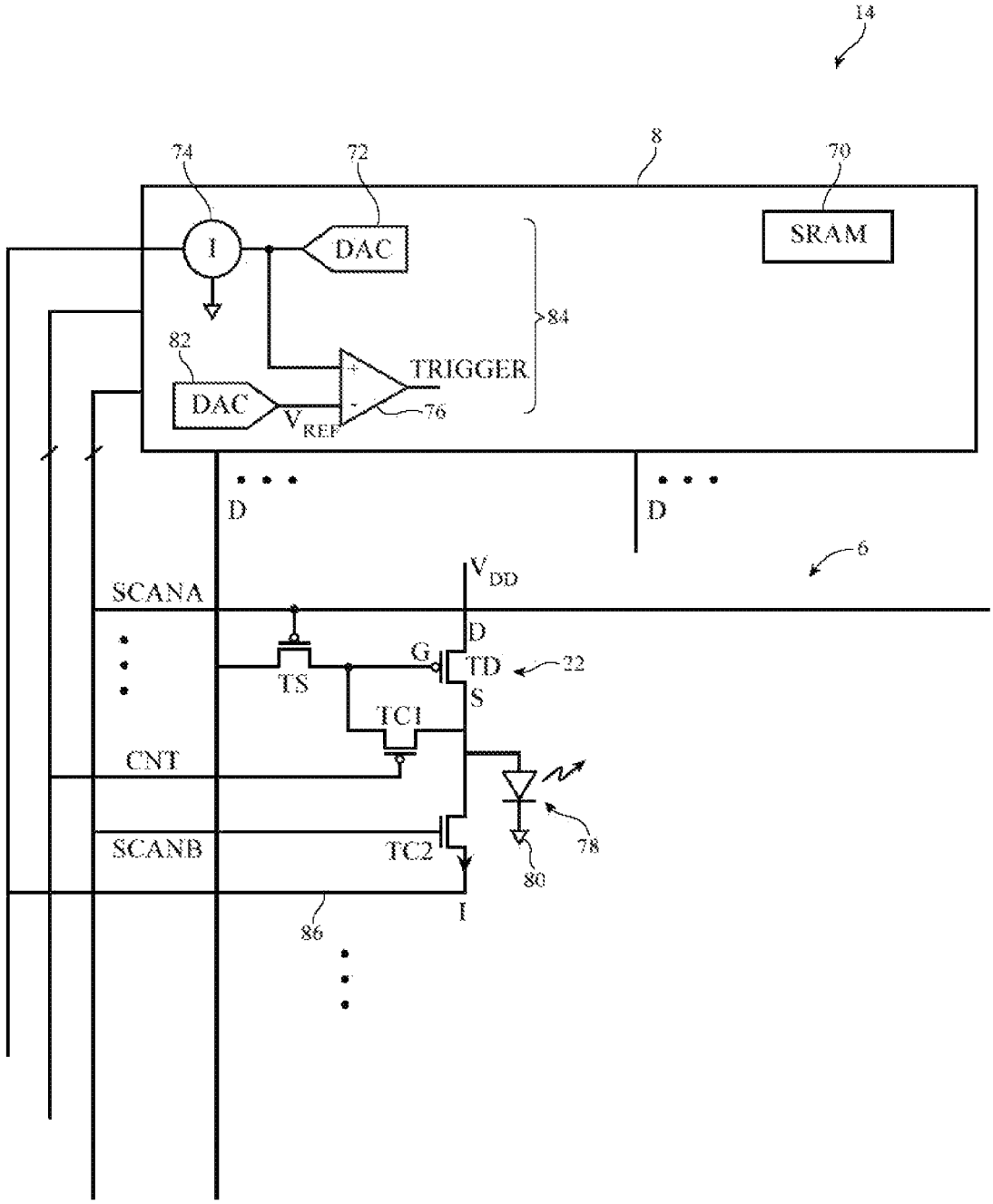
FIG. 7 is a circuit diagram of an illustrative display with calibration circuitry in accordance with an embodiment.

Display 14 may exhibit pixel-to-pixel performance variations. For example, the threshold voltages and other parameters of thin-film transistors in display pixels 22 may vary from pixel to pixel. A compensation scheme in which pixel performance variations are measured and compensated can be used to prevent these variations from creating visible artifacts on display 14. As shown in FIG. 7, display control circuitry 8 may be provided with storage such as storage 70. Storage 70 may be, for example static random-access memory or other memory. Storage 70 may be used to store calibration data for calibrating display pixels 22 in display pixel array 6 to compensate for the effects of performance variations. During operation of display 14, display control circuitry 8 may apply the calibration data from storage 70 (e.g., a frame of calibration data) so that each of the display pixels 22 in array 6 is compensated (calibrated) accordingly.

Calibration data may be obtained by performing periodic measurements on the performance of the transistor structures of display pixels 22. As shown in the illustrative configuration of FIG. 7, display control circuitry 8 may have transistor performance measurement circuitry 84 such as digital-to-analog converter 72, current source 74, digital-to-analog converter 82, and comparator 76. Transistor performance measurement circuitry 84 may apply signals to transistors in pixel array 6 using digital-to-analog converter 72 and current supply 74 and can measure corresponding results with digital analog controller 82 and comparator 76. The results of the performance measurements can be used by control circuitry 8 to characterize the transistors in array 6 and thereby obtain transistor parameters such as threshold voltage, etc. These results may be used by control circuitry 8 in computing calibration data for display 14 that is stored in storage 70.

Display pixels 22 may have thin-film transistors for controlling the application of current to light-emitting diodes such as light-emitting diode 78. As shown in FIG. 7, for example, each display pixel 22 may have a drive transistor TD that is coupled in series with a corresponding light-emitting diode 78 between a source of positive power supply voltage Vdd and ground 80. Drive transistor TD has a drain, gate, and source. Signals can be supplied to the gate of transistor TD in a given row from an associated data line D by turning on scan transistor TS in that row. In particular, display control circuitry 8 can turn on transistors TS in a given row by asserting scan (gate line) signal SCANA in that row. When transistor TS is turned on in a display pixel, the data signal on associated data line D is supplied to the gate G of transistor TD in that display pixel, thereby adjusting the amount of current flowing through transistor TD and light-emitting diode 78. Transistors TC1 and TC2 may be off during normal operation.

When it is desired to characterize transistor TD so that display control circuitry 8 can produce a frame of display pixel calibration data to store in storage 70, display control circuitry 8 can selectively apply measurement signals and monitor resulting signals from transistor TD using circuitry 84.

Figure 8:
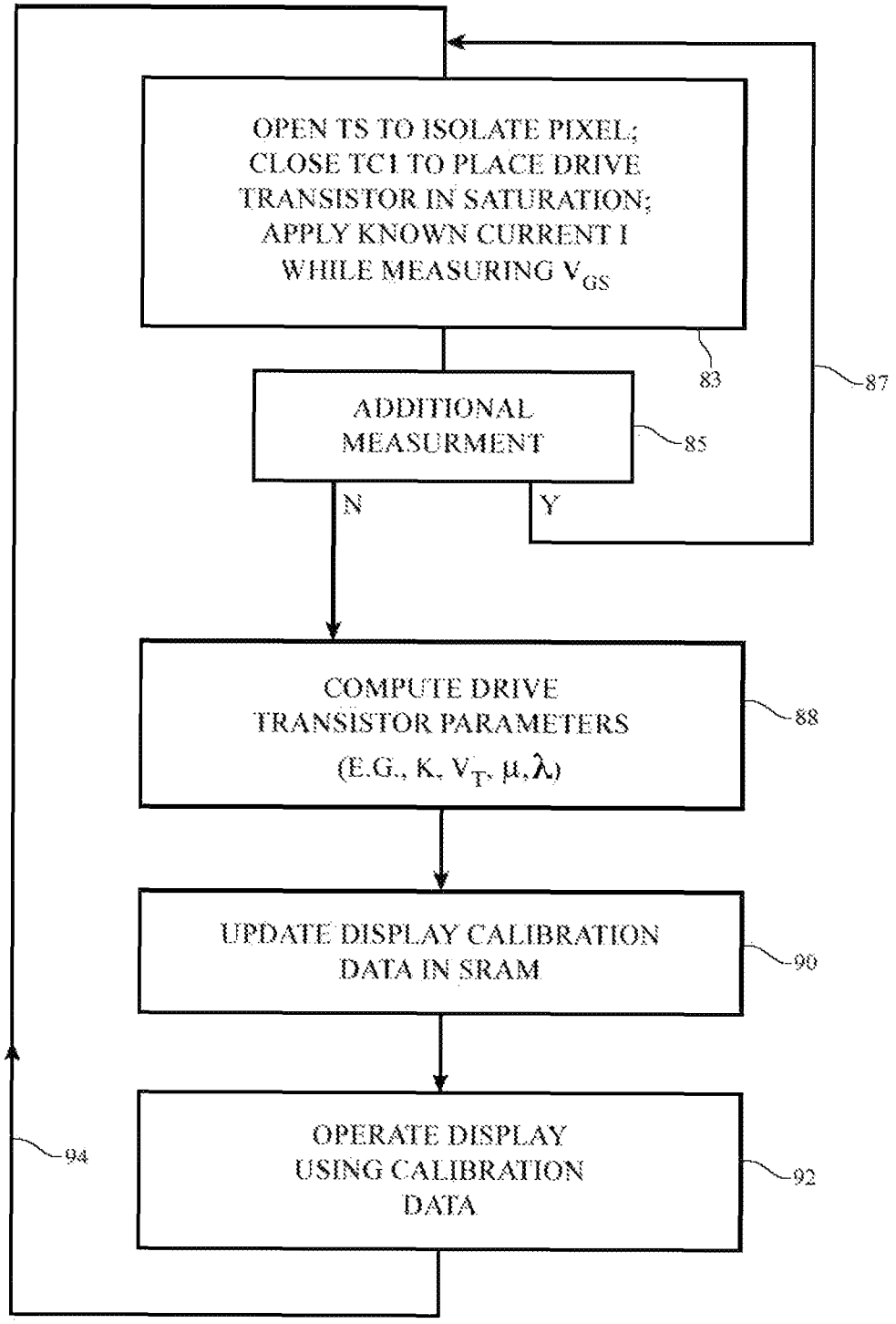
FIG. 8 is a flow chart of illustrative steps involved in operating the calibration circuitry of FIG. 7 in accordance with an embodiment.

A flow chart of illustrative steps involved in operating display 14 using circuitry of the type shown in FIG. 7 is shown in FIG. 8. At step 83, control circuitry 8 deasserts signal SCANA (i.e., SCANA is taken high) to turn off transistor TS. Control circuitry 8 also asserts control signal CNT (i.e., CNT is taken low) to turn on transistor TC1. When transistor TC1 is turned on, gate G and source S of transistor TD are shorted together and transistor TD is placed into saturation. Control circuitry 8 asserts signal SCANB (i.e., SCANB is taken high) to turn on transistor TC2. Digital-to-analog converter 72 is then used to control current source 74 so that a known current I is applied to transistor TD (through transistor TC2). While transistor TD is in saturation and is carrying current I, digital-to-analog converter 82 is used by circuitry 8 to produce a series of different output voltages Vref that are received at one of the inputs of comparator 76. The other input of comparator 76 receives the voltage on line 86 (i.e., the voltage on transistor TD). When output TRIGGER of comparator 76 changes state, control circuitry 8 can conclude the voltage on line 86 is equal to reference voltage Vref. This scheme therefore allows control circuitry 8 to simultaneously measure both the current I and voltage V for transistor TD while transistor TD has been placed in saturation.

At step 85, it is determined whether additional measurements (i.e., measurements at different values of applied current I) are to be gathered. If additional measurements are to be gathered, the operations of display control circuitry 8 loop back to step 83, as indicated by line 86. If all desired measurements for the display pixel have been made, processing may continue to step 88. The measurements of step 83 are preferably made for each display pixel 22 in array 6

(i.e., two or more or three or more measurements are made for each display pixel 22 at two or more or three or more respective different current levels I). Control circuitry 8 preferably has a sufficient number of current sources and voltage detectors to make measurements for an entire row of display pixels 22 at a time (e.g., during a vertical blanking interval or other period of time in which display pixels 22 are not being used to display image data for a user).

Equation 1 sets forth the relationship between measured (known) current I (measured using current source 74), measured transistor voltage Vgs (obtained from the measured voltage on path 87 and known voltage Vdd), and transistor parameters such as threshold voltage Vt, process transconductance K, and channel length modulation factor λ.

$$I=K(Vgs-Vt)^2+\lambda(Vgs-Vt) \quad (1)$$

The number of measurements that are made determines the amount of information that can be gathered by control circuitry 8 on display pixels 22. For example, by making two measurements on a given display pixel at two different current levels, equation 1 can be solved for threshold voltage Vt (i.e., the threshold voltage of transistor TD). From a known value of Vt, transistor parameters such as mobility can be derived. In scenarios in which three measurements on a given display pixel are made, equation 1 can also be solved for channel length modulation factor λ, further facilitating accurate compensation.

After calculating transistor parameters for drive transistor TD at step 88, the calibration data (compensation data) for display 14 that is stored in storage 70 can be updated accordingly.

At step 92, control circuitry 8 can use the stored calibration data to calibrate a frame of data that is being displayed on display 14 (i.e., the known characteristics of each display pixel can be taken into account when supplying a frame of data to display 14 so that pixel-to-pixel variations are compensated). During normal operation, control circuitry 8 turns off transistors TC1 and TC2. Transistor TS is used to load data into each pixel, and drive transistor TD is used to control current flow accordingly through light-emitting diode 78.

The foregoing is merely illustrative and various modifications can be made by those skilled in the art without departing from the scope and spirit of the described embodiments. The foregoing embodiments may be implemented individually or in any combination.

What is claimed is:

1. Display circuitry, comprising:

an array of display pixels; and display control circuitry that displays images on the array of display pixels, wherein the display control circuitry includes:

transistor performance measurement circuitry configured to apply signals to transistors in the array of display pixels and measure corresponding results to obtain threshold voltage information, wherein the display control circuitry is configured to calculate threshold voltage calibration data based on the threshold voltage information, wherein the transistor performance measurement circuitry comprises a digital-to-analog converter and a current supply, wherein the digital-to-analog converter and the current supply are configured to apply the signals to the transistors in the array of display pixels, wherein the transistor performance measurement circuitry comprises an additional digital-to-analog converter and a comparator, and wherein the additional digital-to-analog converter and the comparator are configured to measure the corresponding results to obtain the threshold voltage information; and storage that is configured to store the threshold voltage calibration data, wherein the display control circuitry is configured to operate the array of display pixels using the threshold voltage calibration data from the storage.

2. The display circuitry defined in claim 1, wherein the storage comprises static random-access memory.

3. The display circuitry defined in claim 2, wherein each pixel in the array of display pixels comprises a drive transistor that is coupled in series with a corresponding light emitting diode.

4. The display circuitry defined in claim 3, wherein the digital-to-analog converter and the current supply are configured to apply the signals to the drive transistors.

5. The display circuitry defined in claim 4, wherein each pixel in the array of display pixels further comprises a first transistor that is coupled between the current supply and each drive transistor.

6. The display circuitry defined in claim 5, wherein the digital-to-analog converter and the current supply are configured to apply the signals to the drive transistor through the first transistor.

7. The display circuitry defined in claim 6, further comprising a second transistor that is coupled between a gate and a source of each drive transistor.

8. A method of operating a display, wherein the display comprises an array of display pixels and transistor performance measurement circuitry, the method comprising:

with the transistor performance measurement circuitry, measuring parameters of transistors in the array of display pixels, wherein each pixel in the array of display pixels comprises a drive transistor that is coupled in series with a light emitting diode, a first transistor that is coupled between the drive transistor and a current supply, a second transistor that is coupled between a gate and a source of the drive transistor, and a third transistor that is coupled between the gate of the drive transistor and a data line;

updating stored calibration data based on the measured parameters; and after updating the stored calibration data, operating the display using the stored calibration data.

9. The method defined in claim 8, wherein measuring the parameters of the transistors comprises measuring the parameters of the transistors during a vertical blanking interval.

10. The method defined in claim 8, wherein measuring the parameters of the transistors in the array of display pixels comprises:

turning off the third transistor;

turning on the second transistor; and turning on the first transistor.

11. The method defined in claim 10 wherein measuring the parameters of the transistors in the array of display pixels comprises:

applying a known current to the drive transistor through the first transistor using the current supply; and using the comparator to determine a voltage for the drive transistor.

12. The method defined in claim 11, wherein operating the display using the stored calibration data comprises operating the display to display images on the array of display pixels, and wherein operating the display to display images on the array of display pixels comprises operating the display to display images on the array of display pixels while the first and second transistors are turned off.

13. A method of operating a display, wherein the display comprises an array of display pixels and display control circuitry that displays images on the array of display pixels, wherein the display control circuitry includes transistor performance measurement circuitry, wherein each pixel in the array of display pixels comprises a drive transistor that is coupled in series with a light emitting diode, a first transistor that is coupled between the drive transistor and a current supply, a second transistor that is coupled between a gate and a source of the drive transistor, and a third transistor that is coupled between the gate of the drive transistor and a data line, the method comprising:

turning off the third transistor;

turning on the second transistor to saturate the drive transistor;

turning on the third transistor;

with the transistor performance measurement circuitry, sending first signals to the array of display pixels, wherein sending first signals to the array of display pixels comprises applying a current to the drive transistor through the third transistor;

with the transistor performance measurement circuitry, receiving second signals from the array of display pixels;

comparing the first signals to the second signals to determine parameters for the array of display pixels;

updating stored calibration data based on the determined parameters; and operating the display using the updated stored calibration data.

14. The method defined in claim 13, wherein receiving the second signals from the array of display pixels comprises receiving the second signals at a comparator.

* * * * *